US006718038B1

(12) United States Patent
Cusmario

(10) Patent No.: US 6,718,038 B1
(45) Date of Patent: Apr. 6, 2004

(54) CRYPTOGRAPHIC METHOD USING MODIFIED FRACTIONAL FOURIER TRANSFORM KERNEL

(75) Inventor: Adolf Cusmario, Ellicott City, MD (US)

(73) Assignee: The United States of America as represented by the National Security Agency, Washington, DC (US)

( * ) Notice: Subject to any disclaimer, the term of this patent is extended or adjusted under 35 U.S.C. 154(b) by 1062 days.

(21) Appl. No.: 09/651,719

(22) Filed: Jul. 27, 2000

(51) Int. Cl.[7] ..... H04K 1/00

(52) U.S. Cl. ..... 380/28; 380/30; 380/255; 380/259; 713/164; 713/189; 713/200; 713/201

(58) Field of Search ..... 380/255, 259, 380/260–266, 273, 278, 287, 28, 30, 59, 46, 276, 279; 713/150–152, 164–167, 189, 200, 201, 202, 168; 708/313

(56) References Cited

U.S. PATENT DOCUMENTS

| | | | | | |
|---|---|---|---|---|---|
| 3,959,592 | A | * | 5/1976 | Ehrat | 380/28 |
| 4,052,565 | A | * | 10/1977 | Baxter et al. | 380/28 |
| 4,232,194 | A | * | 11/1980 | Adams | 380/28 |
| 4,393,276 | A | * | 7/1983 | Steele | 380/28 |
| 4,591,673 | A | * | 5/1986 | Lee et al. | 380/28 |
| 4,623,980 | A | * | 11/1986 | Vary | 708/313 |
| 4,747,137 | A | * | 5/1988 | Matsunaga | 380/276 |
| 4,972,480 | A | * | 11/1990 | Rosen | 380/46 |
| 5,677,956 | A | * | 10/1997 | Lafe | 380/28 |
| 5,751,808 | A | * | 5/1998 | Anshel et al. | 713/168 |
| 5,840,033 | A | | 11/1998 | Takeuchi | |
| 5,845,241 | A | | 12/1998 | Owechko | |
| 5,987,128 | A | * | 11/1999 | Baba | 380/279 |

OTHER PUBLICATIONS

Luis B. Almeida, "The Fractional Fourier Transform and Time–Frequency Representations" IEEE Trans. on Signal Proc., vol. 42, No. 11, Nov. 1994.

Adolf W. Lohmann et al., "Relationships Between the Radon–Wigner and Fractional Fourier Transforms," J. Opt. Soc. Am. A/vol. 11, No. 6/Jun. 1994.

* cited by examiner

*Primary Examiner*—Bernarr E. Gregory
(74) *Attorney, Agent, or Firm*—Robert D. Morelli

(57) ABSTRACT

The present invention is a cryptographic method that uses at least one component of a modified fractional Fourier transform kernel a user-definable number of times. For encryption, a signal is received; at least one encryption key is established, where each encryption key includes at least four user-definable variables that represent an angle of rotation, a time exponent, a phase, and a sampling rate; at least one component of a modified fractional Fourier transform kernel is selected, where each component is defined by one of the encryption keys; and the signal is multiplied by the at least one component of a modified fractional Fourier transform kernel selected. For decryption, a signal to be decrypted is received; at least one decryption key is established, where each decryption key corresponds with, and is identical to, an encryption key used to encrypt the signal; at least one component of a modified fractional Fourier transform kernel is selected, where each component corresponds with, and is identical to, a component of a modified fractional Fourier transform kernel used to encrypt the signal; and dividing the signal by the at least one component of a modified fractional Fourier transform kernel selected.

4 Claims, 2 Drawing Sheets

CRYPTOGRAPHIC METHOD USING MODIFIED FRACTIONAL FOURIER TRANSFORM KERNEL

FIELD OF THE INVENTION

The present invention relates, in general, to cryptography, and, in particular, to electric signal modification (e.g., scrambling).

BACKGROUND OF THE INVENTION

The Fourier transform is used to transform a signal in the time domain into a signal in the frequency domain. The fractional Fourier transform is used to transform a signal in the time domain to a signal in the frequency domain, but with a user-definable angle of rotation.

The fractional Fourier transform of a signal S(t) is defined as follows.

$$F_\alpha S(y)=\int S(t)K_\alpha(t)dt$$

The kernel of the fractional Fourier transform is as follows:

$$K_\alpha(t, y)=\sqrt{(1-i\cot\alpha)/(2\pi)}\exp\{0.5i(y^2+t^2)\cot\alpha-iyt\csc\alpha\}$$

if $\alpha$ is not an integer multiple of $\pi$, and $$K_\alpha(t, y)=\delta(t\pm y)$$

if $\alpha$ is an integer multiple of $\pi$, where the sign of the argument in the delta distribution alternates with the parity of the integer, and where the variable i is the square root of −1. Because the fractional Fourier transform kernel includes the square root of −1, the kernel includes both a real component and an imaginary component.

The fractional Fourier transform is further described in an article entitled "The Fractional Fourier Transform and Time-Frequency Representations," by Luís B. Almeida, *IEEE Transactions on Signal Processing*, Vol. 42, No. 11, November 1994, pps. 3084–3091, and in an article entitled "Relationships between the Radon-Wigner and fractional Fourier transforms," by Adolf W. Lohmann and Bernard H. Soffer, *Journal of the Optical Society of America*, Vol. 11, No. 6, June 1994, pps. 1798–1801. Neither article discloses the cryptographic method of the present invention.

U.S. Pat. No. 5,840,033, entitled "METHOD AND APPARATUS FOR ULTRASOUND IMAGING," uses the fractional Fourier transform as disclosed in the above-identified articles as an equivalent method of performing a two-dimensional Fourier transform. U.S. Pat. No. 5,840,033 does not disclose the cryptographic method of the present invention. U.S. Pat. No. 5,840,033 is hereby incorporated by reference into the specification of the present invention.

U.S. Pat. No. 5,845,241, entitled "HIGH-ACCURACY, LOW-DISTORTION TIME-FREQUENCY ANALYSIS OF SIGNALS USING ROTATED-WINDOW SPECTROGRAMS," uses a fractional Fourier transform as disclosed in the above-identified articles to form rotated window spectrograms. U.S. Pat. No. 5,845,241 does not disclose the cryptographic method of the present invention. U.S. Pat. No. 5,845,241 is hereby incorporated by reference into the specification of the present invention.

SUMMARY OF THE INVENTION

It is an object of the present invention to encrypt and decrypt a signal using at least one component of a modified fractional Fourier transform kernel a user-definable number of times.

It is another object of the present invention to encrypt and decrypt a signal using at least one component of a modified fractional Fourier transform kernel a user-definable number of times with at least one encryption key and at least one decryption keys.

The present invention is a cryptographic method using at least one component of a modified fractional Fourier transform kernel a user-definable number of times. Cryptography encompasses both encryption and decryption.

The first step of the method of encryption is receiving a signal to be encrypted.

The second step of the method of encryption is establishing at least one encryption key, where each at least one encryption key includes at least four user-definable variables that represent an angle of rotation, a time exponent, a phase, and a sampling rate.

The third step of the method of encryption is selecting at least one component of a modified fractional Fourier transform kernel, where each at least one component of a modified fractional Fourier transform kernel selected corresponds to, and is defined by, one of the at least one encryption keys.

The fourth, and last, step of the method of encryption is multiplying the signal by the at least one component of a modified fractional Fourier transform kernel selected in the third step.

The first step of the method of decryption is receiving a signal to be decrypted.

The second step of the method of decryption is establishing at least one decryption key, where each at least one decryption key corresponds with, and is identical to, an encryption key used to encrypt the signal.

The third step of the method of decryption is selecting at least one component of a modified fractional Fourier transform kernel, where each at least one component of a modified fractional Fourier transform kernel selected corresponds with, and is identical to, a component of a modified fractional Fourier transform kernel used to encrypt the signal.

The fourth, and last, step of the method of decryption is dividing the signal by the at least one component of a modified fractional Fourier transform kernel selected in the third step.

DETAILED DESCRIPTION

The present invention is a cryptographic method using at least one component of a modified fractional Fourier transform kernel a user-definable number of times. Cryptography encompasses both encryption and decryption. The at least one components of the modified fractional Fourier transform kernel may be used in any combination.

Figure 1:
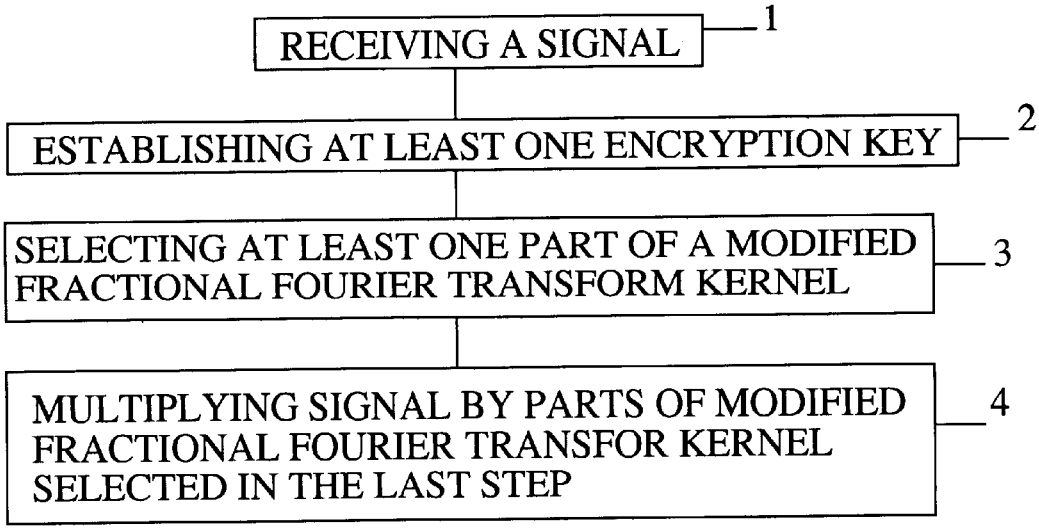
FIG. 1 is a list of the steps of the present invention for encryption.

FIG. 1 is a list of the steps of the present method for encryption.

The first step 1 of the method of encryption is receiving a signal to be encrypted. In the preferred embodiment, the signal is in digital format. However, any other suitable signal format may be used in the present invention.

The second step 2 of the method of encryption is establishing at least one encryption key. Each at least one encryption key includes at least four user-definable variables $\alpha_i$; $\beta_i$, $\gamma_i$, and $\delta_i$, where $\alpha_i$ represents an angle of rotation, where $\beta_i$ represents an exponent of time t, where $\gamma_i$ represents a phase, where $\delta_i$ represents a sampling rate, where $n<\alpha_i<n+1$, where n is an integer, where $\gamma_{i+(}1/\delta_i)<t<\gamma_i+$(the length of the signal)$/\delta_i$, and where the length of the signal is greater than $\delta_i$.

The third step 3 of the method of encryption is selecting at least one component of a modified fractional Fourier transform kernel. Each at least one component of the modified fractional Fourier transform kernel corresponds to, and is defined by, the corresponding at least one encryption key. The at least one component selected may be either the real component or the imaginary component of the modified fractional Fourier transform kernel. The components of the modified. fractional Fourier transform kernel may be selected in any combination.

The fractional Fourier transform kernel described in the background section was modified to produce the modified fractional Fourier transform kernel as follows:

$$Q_{\alpha\beta}(t, y)=\exp\{it^{\beta}\mathrm{trig}(\alpha)\},$$

if $\alpha$ is not an integer multiple of $\pi$, where trig($\alpha$) is a trigonometric function selected from the group of trigonometric functions consisting of sin($\alpha$), cos($\alpha$), tan($\alpha$), cot($\alpha$), sec($\alpha$), and csc($\alpha$); and where $\beta$ is a real number. As compared to the fractional Fourier transform kernel described in the background section, the modified fractional Fourier transform kernel of the present invention includes a time exponent that is not limited to a particular value, and includes various trigonometric functions that allow the user to control the angle of rotation with greater diversity. The modified fractional Fourier transform kernel includes the variable i, which is the square root of −1, and, therefore includes a real component and an imaginary component. However, the present invention does not require the use of both components as does the prior art. Furthermore, the prior art fractional Fourier transform kernel only uses the cotangent and cosecant functions, whereas the present invention is not so limited.

The present invention uses the following components of the modified fractional Fourier transform kernel:

$$q1_{\alpha\beta}(t)=\cos(t^{\beta}\sin(\pi\alpha/2));$$

$$q2_{\alpha\beta}(t)=\mathrm{signum}(\cos(t^{\beta}\sin(\pi\alpha/2)));$$

$$q3_{\alpha\beta}(t)=\cos(t^{\beta}\cos(\pi\alpha/2));$$

$$q4_{\alpha\beta}(t)=\mathrm{signum}(\cos(t^{\beta}\cos(\pi\alpha/2)));$$

$$q5_{\alpha\beta}(t)=\cos(t^{\beta}\tan(\pi\alpha/2));$$

$$q6_{\alpha\beta}(t)=\mathrm{signum}(\cos(t^{\beta}\tan(\pi\alpha/2)));$$

$$q7_{\alpha\beta}(t)=\cos(t^{\beta}\cot(\pi\alpha/2));$$

$$q8_{\alpha\beta}(t)=\mathrm{signum}(\cos(t^{\beta}\cot(\pi\alpha/2)));$$

$$q9_{\alpha\beta}(t)=\cos(t^{\beta}\sec(\pi\alpha/2));$$

$$q10_{\alpha\beta}(t)=\mathrm{signum}(\cos(t^{\beta}\sec(\pi\alpha/2)));$$

$$q11_{\alpha\beta}(t)=\cos(t^{\beta}\csc(\pi\alpha/2));$$

$$q12_{\alpha\beta}(t)=\mathrm{signum}(\cos(t^{\beta}\csc(\pi\alpha/2)));$$

$$q14_{\alpha\beta}(t)=\mathrm{signum}(\sin(t^{\beta}\sin(\pi\alpha/2)));$$

$$q15_{\alpha\beta}(t)=\sin(t^{\beta}\cos(\pi\alpha/2));$$

$$q16_{\alpha\beta}(t)=\mathrm{signum}(\sin(t^{\beta}\cos(\pi\alpha/2)));$$

$$q17_{\alpha\beta}(t)=\sin(t^{\beta}\tan(\pi\alpha/2));$$

$$q18_{\alpha\beta}(t)=\mathrm{signum}(\sin(t^{\beta}\tan(\pi\alpha/2)));$$

$$q19_{\alpha\beta}(t)=\sin(t^{\beta}\cot(\pi\alpha/2));$$

$$q20_{\alpha\beta}(t)=\mathrm{signum}(\sin(t^{\beta}\cot(\pi\alpha/2)));$$

$$q21_{\alpha\beta}(t)=\sin(t^{\beta}\sec(\pi\alpha/2));$$

$$q22_{\alpha\beta}(t)=\mathrm{signum}(\sin(t^{\beta}\sec(\pi\alpha/2)));$$

$$q23_{\alpha\beta}(t)=\sin(t^{\beta}\csc(\pi\alpha/2));\text{ and}$$

$$q24_{\alpha\beta}(t)=\mathrm{signum}(\sin(t^{\beta}\csc(\pi\alpha/2))).$$

Signum is a function that returns a 1 if the expression on which the function operates is positive, returns a 0 if the expression on which the function operates is zero, and returns a −1 if the expression on which the function operates is negative. Using the modified fractional Fourier transform kernels that include the signum function will preserve the integer range of the signal being encrypted. That is, the encrypted signal will be an integer if the unencrypted signal is an integer and the modified fractional Fourier transform kernel used during encryption includes the signum function.

In the present invention, the components of the modified fractional Fourier transform kernel that begin with the cosine function are real components, while the components that begin with the sine function are imaginary components. These components may be selected in any number and combination. That is, any component may be selected any number of times, and any combination of these components may be selected. The cryptographic strength of the encryption method of the present invention is proportional to the number, type, and combination of components of the modified fractional Fourier transform kernel selected in the third step 3.

At least one encryption key (i.e., ($\alpha$, $\beta$, $\gamma$, $\delta$)) is used with the components of the modified fractional Fourier transform kernel selected in the third step 3. However, each component selected, or each instance of a component selected, may have its own unique encryption key (i.e., ($\alpha_i$, $\beta_i$, $\gamma_i$, $\delta_i$)). The cryptographic strength of the encryption method of the present invention is proportional to the number and diversity of encryption keys established in the second step 2. Any number and diversity of encryption keys may be used in the present encryption method.

The fourth, and last, step 4 of the method of encryption is multiplying the signal by the at least one component of a modified fractional Fourier transform kernel selected in the third step 3. If the signal to be encrypted is a digital signal then the multiplication of the fourth step 4 is performed on a sample by sample basis.

Figure 2:
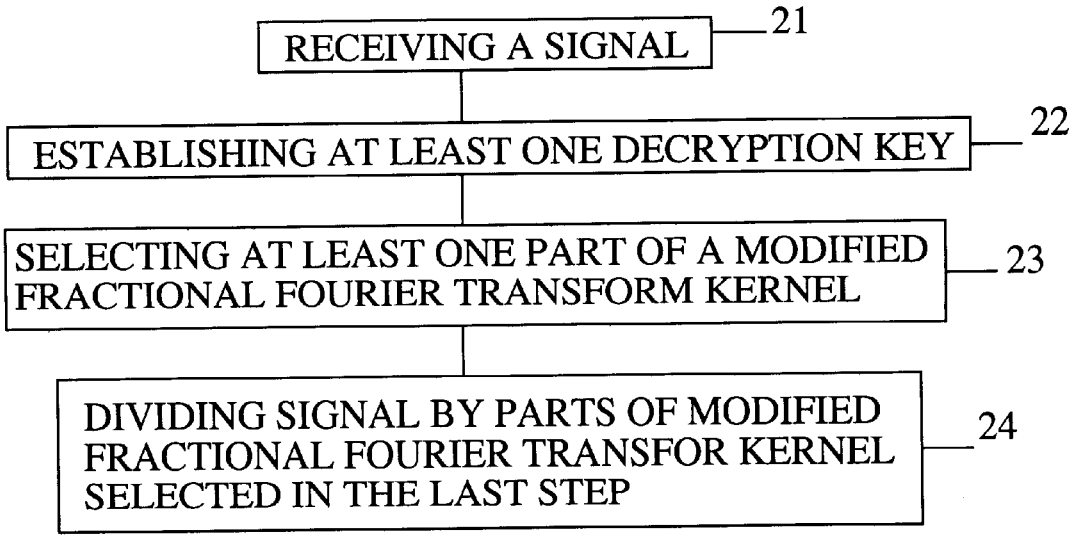
FIG. 2 is a list of the steps of the present invention for decryption

FIG. 2 is a list of the steps of the present method for decryption.

The first step 21 of the method of decryption is receiving a signal to be decrypted. In the preferred embodiment, the signal is in digital format. However, any other suitable signal format may be used in the present invention.

The second step 22 of the method of decryption is establishing at least one decryption key. Each decryption key corresponds with, and is identical to, an encryption key used to encrypt the signal. Each decryption key includes at least four user-definable variables $\alpha_i$, $\beta_i$, $\gamma_i$, and $\delta_i$, where $\alpha_i$ represents a rotational angle, where $\beta_i$ represents an exponent of time t, where $\gamma_i$ represents a phase, where $\delta_i$ represents a sampling rate, where $n<\alpha_i<n+1$, where n is an integer, where $\gamma_i+(1/\delta_i)<t<\gamma_i+$(*the length of the signal*)$/\delta_i$, and where the length of the signal is greater than $\delta_i$.

The third step 23 of the method of decryption is selecting at least one component of a modified fractional Fourier transform kernel. Each at least one component of the modified fractional Fourier transform kernel corresponds to, and is defined by, its corresponding decryption key. Also, each at least one component of the modified fractional Fourier transform kernel corresponds with, and is identical to, a component of a modified fractional Fourier transform kernel used to encrypt the signal. The components of the modified fractional Fourier transform may be selected in any combination.

The modified fractional Fourier transform kernel used in the encryption method of the present invention is also used in the decryption method of the present invention. Also, the at least one component of the modified fractional Fourier transform kernel used in the encryption method of the present invention is also used in the decryption method of the present invention. These components may be selected in any number and combination. That is, any component may be selected any number of times, and any combination of these components may be selected. The cryptographic strength of the decryption method of the present invention is proportional to the number, type, and combination of components of the modified fractional Fourier transform kernel selected in the third step 23.

At least one decryption key (i.e., $(\alpha, \beta, \gamma, \delta)$) is used with the components of the modified fractional Fourier transform kernel selected in the third step 23. The decryption keys established in the second step 22 are identical to the encryption keys established to encrypt the signal.

The fourth step 24 of the method of decryption is dividing the signal by the at least one component of the modified fractional Fourier transform kernel selected in the third step 23. If the signal to be decrypted is a digital signal then the division of the fourth step 24 is performed on a sample by sample basis.

The present invention may be used to encrypt a header to a message so that the encrypted header acts as an electronic signature.

What is claimed is:

1. A method of encryption, comprising the steps of:

a) receiving a signal to be encrypted, where the signal has a length;

b) establishing at least one encryption key, where each at least one encryption key includes at least four user-definable variables $\alpha_i$, $\beta_i$, $\gamma_i$, and $\delta_i$, where $\alpha_i$ represents an angle of rotation, where $\beta_i$ represents an exponent of time t, where $\gamma_i$ represents a phase, where $\delta_i$ represents a sampling rate, where $n<\alpha_i<n+1$, where n is an integer, where $\gamma_i+(1/\delta_i)<t<\gamma_i+(\textit{the length of the signal})/\delta_i$, and where the length of the signal is greater than $\delta_i$;

c) selecting at least one modified fractional Fourier transform function, where each at least one modified fractional Fourier transform function corresponds to, and is defined by, the corresponding at least one encryption key; and d) multiplying the signal by the at least one modified fractional Fourier transform function selected in step (c).

2. The method of claim 1, wherein said step of selecting at least one modified fractional Fourier transform function is comprised of the step of selecting at least one modified fractional Fourier transform function from the group of modified fractional Fourier transform functions consisting of:

$$q1_{\alpha\beta}(t)=\cos(t^{\beta}\sin(\pi\alpha/2));$$

$$q2_{\alpha\beta}(t)=\text{signum}(\cos(t^{\beta}\sin(\pi\alpha/2)));$$

$$q3_{\alpha\beta}(t)=\cos(t^{\beta}\cos(\pi\alpha/2));$$

$$q4_{\alpha\beta}(t)=\text{signum}(\cos(t^{\beta}\cos(\pi\alpha/2)));$$

$$q5_{\alpha\beta}(t)=\cos(t^{\beta}\tan(\pi\alpha/2));$$

$$q6_{\alpha\beta}(t)=\text{signum}(\cos(t^{\beta}\tan(\pi\alpha/2)));$$

$$q7_{\alpha\beta}(t)=\cos(t^{\beta}\cot(\pi\alpha/2));$$

$$q8_{\alpha\beta}(t)=\text{signum}(\cos(t^{\beta}\cot(\pi\alpha/2)));$$

$$q9_{\alpha\beta}(t)=\cos(t^{\beta}\sec(\pi\alpha/2));$$

$$q10_{\alpha\beta}(t)=\text{signum}(\cos(t^{\beta}\sec(\pi\alpha/2)));$$

$$q11_{\alpha\beta}(t)=\cos(t^{\beta}\csc(\pi\alpha/2));$$

$$q12_{\alpha\beta}(t)=\text{signum}(\cos(t^{\beta}\csc(\pi\alpha/2)));$$

$$q13_{\alpha\beta}(t)=\sin(t^{\beta}\sin(\pi\alpha/2));$$

$$q14_{\alpha\beta}(t)=\text{signum}(\sin(t^{\beta}\sin(\pi\alpha/2)));$$

$$q15_{\alpha\beta}(t)=\sin(t^{\beta}\cos(\pi\alpha/2));$$

$$q16_{\alpha\beta}(t)=\text{signum}(\sin(t^{\beta}\cos(\pi\alpha/2)));$$

$$q17_{\alpha\beta}(t)=\sin(t^{\beta}\tan(\pi\alpha/2));$$

$$q18_{\alpha\beta}(t)=\text{signum}(\sin(t^{\beta}\tan(\pi\alpha/2)));$$

$$q19_{\alpha\beta}(t)=\sin(t^{\beta}\cot(\pi\alpha/2));$$

$$q20_{\alpha\beta}(t)=\text{signum}(\sin(t^{\beta}\cot(\pi\alpha/2)));$$

$$q21_{\alpha\beta}(t)=\sin(t^{\beta}\sec(\pi\alpha/2));$$

$$q22_{\alpha\beta}(t)=\text{signum}(\sin(t^{\beta}\sec(\pi\alpha/2)));$$

$$q23_{\alpha\beta}(t)=\sin(t^{\beta}\csc(\pi\alpha/2));\text{ and}$$

$$q24_{\alpha\beta}(t)=\text{signum}(\sin(t^{\beta}\csc(\pi\alpha/2))),$$

where signum is a function that returns a 1 if an expression on which the signum function operates is positive, returns a 0 if the expression on which the signum function operates is zero, and returns a −1 if the expression on which the signum function operates is negative.

3. A method of decryption, comprising the steps of:

a) receiving a signal to be decrypted, where the signal has a length;

b) establishing at least one decryption key, where each at least one decryption key corresponds with, and is identical to, an encryption key used to encrypt the signal, where each at least one decryption key includes at least four user-definable variables $\alpha_i$, $\beta_i$, $\gamma_i$, and $\delta_i$, where $\alpha_i$ represents a rotational angle, where $\beta_i$ represents an exponent of time t, where $\gamma_i$ represents a phase, where $\delta_i$ represents a sampling rate, where $n<\alpha_i<n+1$, where n is an integer, where $\gamma_i+(1/\delta_i)<t<\gamma_i+(\textit{the length of the signal})/\delta_i$, and where the length of the signal is greater than $\delta_i$;

c) selecting at least one modified fractional Fourier transform function, where each at least one modified fractional Fourier transform function corresponds to, and is defined by, the corresponding at least one decryption key, where each at least one modified fractional Fourier transform function corresponds with, and is identical to, a modified fractional Fourier transform function used to encrypt the signal; and d) dividing the signal by the at least one modified fractional Fourier transform function selected in step (c).

4. The method of claim 3, wherein said step of selecting at least one modified fractional Fourier transform function is comprised of the step of selecting at least one modified fractional Fourier transform function from the group of modified fractional Fourier transform functions consisting of:

$$q1_{\alpha\beta}(t)=\cos(t^{\beta}\sin(\pi\alpha/2));$$

$$q2_{\alpha\beta}(t)=\text{signum}(\cos(t^{\beta}\sin(\pi\alpha/2)));$$

$$q3_{\alpha\beta}(t)=\cos(t^{\beta}\cos(\pi\alpha/2));$$

$$q4_{\alpha\beta}(t)=\text{signum}(\cos(t^{\beta}\cos(\pi\alpha/2)));$$

$$q5_{\alpha\beta}(t)=\cos(t^{\beta}\tan(\pi\alpha/2));$$

$$q6_{\alpha\beta}(t)=\text{signum}(\cos(t^{\beta}\tan(\pi\alpha/2)));$$

$$q7_{\alpha\beta}(t)=\cos(t^{\beta}\cot(\pi\alpha/2));$$

$$q8_{\alpha\beta}(t)=\text{signum}(\cos(t^{\beta}\cot(\pi\alpha/2)));$$

$$q9_{\alpha\beta}(t)=\cos(t^{\beta}\sec(\pi\alpha/2));$$

$$q10_{\alpha\beta}(t)=\text{signum}(\cos(t^{\beta}\sec(\pi\alpha/2)));$$

$$q11_{\alpha\beta}(t)=\cos(t^{\beta}\csc(\pi\alpha/2));$$

$$q12_{\alpha\beta}(t)=\text{signum}(\cos(t^{\beta}\csc(\pi\alpha/2)));$$

$$q13_{\alpha\beta}(t)=\sin(t^{\beta}\sin(\pi\alpha/2));$$

$$q14_{\alpha\beta}(t)=\text{signum}(\sin(t^{\beta}\sin(\pi\alpha/2)));$$

$$q15_{\alpha\beta}(t)=\sin(t^{\beta}\cos(\pi\alpha/2));$$

$$q16_{\alpha\beta}(t)=\text{signum}(\sin(t^{\beta}\cos(\pi\alpha/2)));$$

$$q17_{\alpha\beta}(t)=\sin(t^{\beta}\tan(\pi\alpha/2));$$

$$q18_{\alpha\beta}(t)=\text{signum}(\sin(t^{\beta}\tan(\pi\alpha/2)));$$

$$q19_{\alpha\beta}(t)=\sin(t^{\beta}\cot(\pi\alpha/2));$$

$$q20_{\alpha\beta}(t)=\text{signum}(\sin(t^{\beta}\cot(\pi\alpha/2)));$$

$$q21_{\alpha\beta}(t)=\sin(t^{\beta}\sec(\pi\alpha/2));$$

$$q22_{\alpha\beta}(t)=\text{signum}(\sin(t^{\beta}\sec(\pi\alpha/2)))$$

$$q23_{\alpha\beta}(t)=\sin(t^{\beta}\csc(\pi\alpha/2)); \text{ and}$$

$$q24_{\alpha\beta}(t)=\text{signum}(\sin(t^{\beta}\csc(\pi\alpha/2))),$$

where signum is a function that returns a 1 if an expression on which the signum function operates is positive, returns a 0 if the expression on which the signum function operates is zero, and returns a −1 if the expression on which the signum function operates is negative.

* * * * *